United States Patent [19]

Keane

[11] 4,090,371

[45] May 23, 1978

[54] MONITOR AND CONTROL FOR REFRIGERATION SYSTEM

[75] Inventor: James Keane, York, Pa.

[73] Assignee: Technological Enterprises Corp., Southboro, Mass.

[21] Appl. No.: 634,846

[22] Filed: Nov. 24, 1975

[51] Int. Cl.[2] ..... F25B 43/02

[52] U.S. Cl. ..... 62/129; 62/193

[58] Field of Search ..... 62/469, 126, 129, 84, 62/193

[56] References Cited

U.S. PATENT DOCUMENTS

| | | | |
|---|---|---|---|
| 3,049,887 | 8/1962 | Sharp et al. | 62/55 |
| 3,744,267 | 7/1973 | Norbeck | 62/193 |

*Primary Examiner*—William E. Wayner

*Attorney, Agent, or Firm*—Robert L. Slater, Jr.

[57] ABSTRACT

A device for monitoring the physical and thermodynamic states and concentration of components of a fluid mixture within an operating refrigeration system to detect precursor conditions of system malfunction. Monitoring and detecting refrigeration system fluids is accomplished by continuously sampling the fluids at critical positions within the system during operation. The sampling is accomplished by means of a plurality of sensors positioned within and adapted to detect changes in the heat constants of the fluids. Electronic circuit means utilizing voltage signals derived from the sensors discriminates between normal operating conditions and malfunction precursor conditions. The electronic circuit output is applied to control operation of the system to prevent system damage and to actuate the system status visual display.

8 Claims, 3 Drawing Figures

MONITOR AND CONTROL FOR REFRIGERATION SYSTEM

BACKGROUND OF THE INVENTION

1. Field of the Invention

The present invention relates to refrigeration systems and more particularly to refrigeration system status monitors operatively correlated with automatic controls.

2. Description of the Prior Art

Failure of commercial refrigeration and air conditioning systems often risks significant secondary financial losses. Insurance against unforseen loss due to refrigeration system malfunction or failure is commonly carried at substantial cost by businesses utilizing frozen and chilled food storage, frozen food retail displays, air conditioning for theaters, sales rooms, computer equipment facilities, and many other commercial and industrial operations adversely sensitive to conditions of excessive heat or humidity.

Refrigeration monitoring equipment presently exists which senses and indicates operational status of refrigeration systems at the time of or subsequent to equipment malfunction or failure. During night time hours and on weekends and holidays when attendants or when refrigeration maintenance service is not readily available, current status indicators are not adequate to prevent serious losses following refrigeration system breakdowns. The present invention is directed to provide advance warning of likely refrigeration system malfunction as well as current system status indicators.

Refrigeration system failure with minor exceptions, is due to one of three conditions. These are leakage into or out of the system, circulation malfunction or improper compressor lubricant oil conditions. Of these three causes of malfunction or failure, the last, inadequate compressor lubrication, is the most frequent and most often the cause of catastrophic system malfunction. Refrigeration compressor lubrication is unique in that the refrigerant fluid mixes with the lubricating oil and creates lubrication hazards not commonly encountered in other classes of high speed rotating machinery.

The present invention, directly or indirectly, senses system malfunction precursor conditions brought about by any one or combinations of the foregoing causes of failure.

The quantity of refrigerant in a typical commercial size system may be twenty or more times greater than the quantity of lubricating crankcase oil in the system compressor. Normally, a portion of the crankcase oil is carried around the refrigeration system by the refrigerant. However, if too much oil leaves the compressor crankcase, or if too much oil is suddenly returned with the refrigerant to the compressor through the compressor inlet, failure of the compressor may result.

Should the liquid refrigerant replace the oil in the compressor crankcase during an inversion of the oil and refrigerant, which may occur with certain commonly used refrigerants when a sufficiently low crankcase temperature is attained, the oil in the compressor will be very completely swept out of the compressor and all lubricated interaction of the moving parts and bearing surfaces of the compressor will quickly be lost. Rapid catastrophic failure of the compressor and of the system results.

The presence of air or moisture in the system mixed with the refrigerant reduces the cooling capacity of the system and overburdens the compressor and other system components. Air and moisture commonly enter into refrigeration systems through small leaks or are present from the time the system was last sealed. Such small leaks or residues of air or moisture are often not detected during routine maintenance inspection.

The presence of liquid refrigerant in the low pressure gas return line may result in the compressor inlet being filled with liquid refrigerant. Such a condition is often encountered during temporary shutdowns. If the compressor should then be started, immediate damage to the compressor and system failure is likely to result.

With only infrequently occurring exceptions, the above enumerated conditions underlying refrigeration system malfunctions and failures are characterized by gradually worsening precursor physical and thermodynamic conditions within the refrigeration system fluid mixtures. The compressor crankcase provides one convenient site for mounting sensors for the purpose of monitoring and detecting critical fluid mixture conditions characteristic of normal operation, as well as those fluid mixture conditions characteristic of precursor malfunction conditions.

The normal operating dynamic range of the sensible properties of refrigeration fluid mixtures, temperature, pressure, density, heat dissipation constants and others is very large. Static detection systems, which depend upon sensing a single parameter, accordingly, are of little use in discriminating between, on the one hand, normal and on the other hand, incipient precursor malfunction conditions. It is in sensing the changing relationships between physical properties within the refrigeration fluids, that precursor malfunction conditions may be readily detected.

Refrigeration malfunction causal factors frequently include an extreme temperature or thermodynamic property excursion of the refrigerant mixture. With the passage of time following the system malfunction but prior to the arrival of refrigeration service people, the refrigeration fluids may and often do change temperature, or thermodynamic state. Thus, the refrigeration service and repair work may be extremely baffling and time consuming to track down an intermittent and transitory cause of system malfunction. A means to record unusual conditions, even transitory phenomena occurring within the refrigerant mixtures would, if available, greatly aid diagnosis for maintenance service. Heretofore, refrigeration monitoring equipment, except for temperature recording of the freezer compartment itself, has failed to record operating status conditions within the system.

SUMMARY

The present invention is a device comprised of a plurality of electronic sensors mounted in a vertically spaced relationship in contact with the fluids at convenient locations within a refrigeration system. The sensors are responsive to the rate of ambient heat dissipation. Multichanneled electronic circuit means responsive to the sensor output voltages, compares each sensor output voltage, respectively, with the remaining other sensor voltages; logic circuit means with bistable elements distinguishes those sensed conditions characteristic of normal operation, from those conditions characteristic of precursors to system malfunction. Output of the logic circuit provides three functions. The logic circuit output actuates memory means useful for a speedy diagnosis of the system malfunction, actuates visual system status means display and actuates system controls designed to prevent damage to components of the system during malfunction.

OBJECTS OF THE INVENTION

A first object of my invention is to provide a device for advance warning prior to refrigeration system malfunction or failure.

Still another object of my invention is to provide a refrigeration system monitoring device with the capability during certain malfunction episodes of shutting down the system prior to catastrophic failure and resultant damage to system components.

Another object of my invention is to provide a device for monitoring the internal physical and thermodynamic conditions within the circulating fluid mixtures of a refrigeration system for the purpose of discriminating between normal and non-normal operating conditions.

Yet another object of my invention is to provide a device capable of monitoring the internal physical and thermodynamic environment of a refrigeration system and recording in a memory the precursor conditions to malfunction thereof in order to provide diagnostic information for speedy repair of a malfunctioning system.

These and other objects and advantages of my invention, as defined in the claims, will be apparent to skilled persons from the following illustrative drawings and descriptions in the specification of preferred embodiments.

BRIEF DESCRIPTION OF DRAWINGS

Referring to the drawins which are intended for illustrative purposes only.

DESCRIPTION OF THE INVENTION

Figure 1:
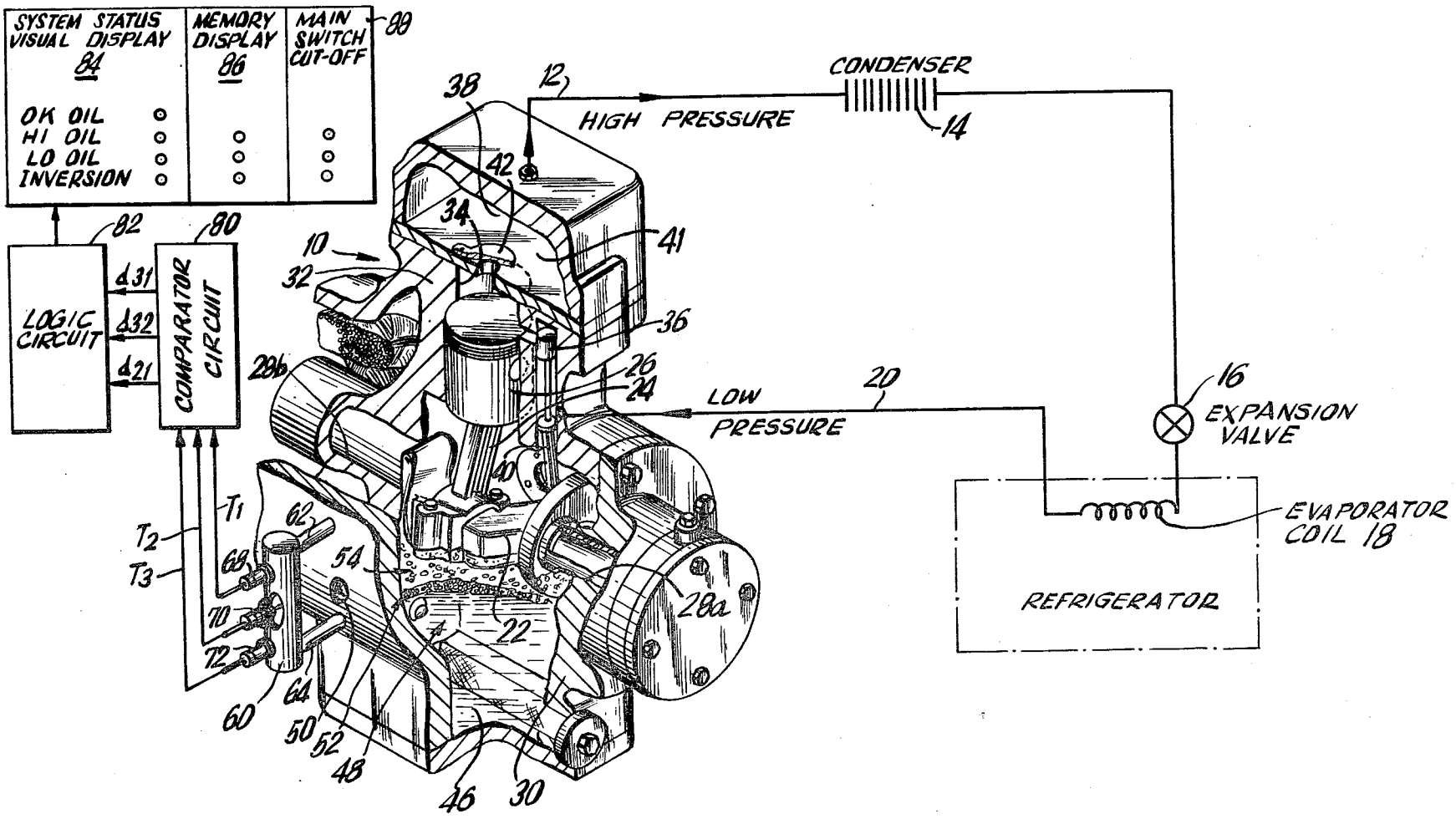
FIG. 1 is a schematic representation of a preferred embodiment of my invention shown mounted to a partially cutaway view of a typical refrigeration compressor.

Referring now to FIG. 1, a schematic illustration of a partly cutaway perspective view shows a typical refrigeration system compressor 10. The illustrated compressor is shown connected to a simplified refrigeration system. The refrigeration system shown in the drawings has a high pressure line 12 which terminates in a condenser 14, an expansion valve 16 and an evaporation coil 18 in which the desired cooling effect is achieved. The evaporation coil 18 is shown placed inside a thermally insulated refrigeration enclosure. The refrigeration system circulation is completed through a low pressure return line 20 which connects to the input valve of the compressor.

The compressor 10 is comprised of a crankshaft 22, a connecting rod 24 and piston 26. The crankshaft ends are retained with bearings **28*a*, 28*b*. The bearings are mounted within a crankcase 30. A cylinder block 32 provides the cylinder 34 within which the piston operates and through which the low pressure line 20 connects to an intake valve 36. The high pressure line 12 connects to the high pressure manifold 40**.

The low pressure intake valve 36 is actuated by a valve lifter linkage 41, which in turn is coupled to the drive shaft 22. A pressure actuated check valve 42 separates the cylinder 34 from the high pressure manifold and provides isolation of the high pressure manifold from the cylinder during the low pressure portion of the cylinder cycle.

The interior of the crankcase 30 provides a reservoir 46 for lubricating oil shown at 48. The crankshaft bearings **28*a*, 28*b* and the connecting rod 24 and its bearings, are lubricated at bearing surfaces in contact with the crankshaft 22, all of which surfaces require continuous lubrication to avoid heating, excessive wear and consequent failure. The lubricating oil level within the crankcase must be maintained within narrow limits to provide the required lubrication. Most compressors are provided with an oil level viewing glass, shown at 50**, so that periodically the compressor crankcase oil level may be visually inspected to insure that a sufficient amount of oil is at all time available in the crankcase.

Referring again to the conditions within the crankcase of an operating compressor, a quantity of refrigerant will normally pass the piston rings and valves and accumulate in the compressor crankcase. This is shown as a layer at 52 above the lubricating oil 48, foam at 54 comprised of a gaseous and liquid mixture of lubricating oil and refrigerant. The oil layer 48 and the liquid refrigerant layer 52 are also mixtures of varying concentrations of lubricant oil, refrigerant and incompressible substances such as air or water vapor if these latter substances are present in the system.

My invention as shown in the preferred embodiment illustrated in FIG. 1, comprises a hollow settling tube 60 attached at the top and bottom, respectively, to the compressor crankcase 30 by means of hollow tubes 62 and 64. The fluid contents at pressures and thermodynamic states existing within the interior of the crankcase are rapidly communicated through the tubes 62 and 64 to the interior of settling tube 60.

The settling tube 62 is provided with three ports through which electrically responsive sensors may be mounted. In the embodiment illustrated, the three probes or sensor shown at 68, 70 and 72 are solid state thermistors. The sensors are operated in the self heat mode and in effect are responsive to the rate of ambient heat dissipation in the medium surrounding each sensor.

The heat dissipation property of a foam or vapor differ significantly from that of a liquid. Within a liquid mixture, the heat dissipation constant varies substantially with the composition of the liquid mixture. Thus, the thermistors sensors readily distinguish between a gaseous layer and a liquid layer. However, within a liquid comprised of density induced layers or comprised of a homogeneous mixture, the sensors will readily distinguish the presence of a layered structure from a homogeneous mixture and also provide critical information for identifying the composition of the layers. For instance, a layer of oil may be readily distinguished from a layer of liquid refrigerant or from a layer of mixed refrigerant and oil.

The sensors 69, 70 and 72 are connected, respectively, to electrical leads $T_1$, $T_2$, and $T_3$. The leads $T_1$, $T_2$ and $T_3$ connect to a comparator circuit 80. The comparator circuit 80 feeds data through three leads shown as $d_{31}$, $d_{32}$, and $d_{21}$ to a logic circuit 82. The logic circuit 82 provides the signals at its output which activates the status visual display 84, the memory display 86, and main switch automatic cutoff 88. The comparator and logic circuits, 80 and 82, respectively, are illustrated in schematic detail in FIG. 2.

By comparing the output signals each with the others from the sensors 68, 70 and 72 referred to below, respectively, as $T_1$, $T_2$ and $T_3$ for purposes of describing the circuit in FIG. 2, the relevant information concerning the key internal conditions of the system may be derived. These four key conditions are:

1. OK oil level
2. High oil level
3. Low oil level
4. Inversion or replacement of oil in lower crankcase by mixture comprised mainly of liquid refrigerant.

The comparisons may be accomplished electronically by substracting the thermistor signals, each one from the others. For example:

$$d_{32} = T_3 - T_2$$

$$d_{31} = T_3 - T_1$$

$$d_{21} = T_2 - T_1$$

If the thermistors are selected and biased so that the following ratio of signal levels (voltages) are obtained:

vapor = 0
oil = 1
refrigerant = 2 then the following truth table may be constructed.

TABLE I

COMPARATOR CIRCUIT TRUTH TABLE

| | THERMISTOR SIGNAL | | | COMPARATOR OUTPUT SIGNAL | | |
|---|---|---|---|---|---|---|
| CONDITION | $T_1$ | $T_2$ | $T_3$ | $d_{32}$ | $d_{31}$ | $d_{21}$ |
| HI OIL | 1 | 1 | 1 | 0 | 0 | 0 |
| OK OIL | 0 | 1 | 1 | 0 | 1 | 1 |
| LO OIL | 0 | 0 | 1 | 1 | 1 | 0 |
| INVERSION | 0 | 1 | 2 | 1 | 2 | 1 |

The comparator circuit output signals may be converted to binary output signals without loss of discrimination by eliminating the signals derived from $d_{31}$; then the logic circuit 82 input is:

| | $d_{32}$ | $d_{21}$ |
|---|---|---|
| HI OIL | 0 | 0 |
| OK OIL | 0 | 1 |
| LO OIL | 1 | 0 |
| INVERSION | 1 | 1 |

Figure 2:
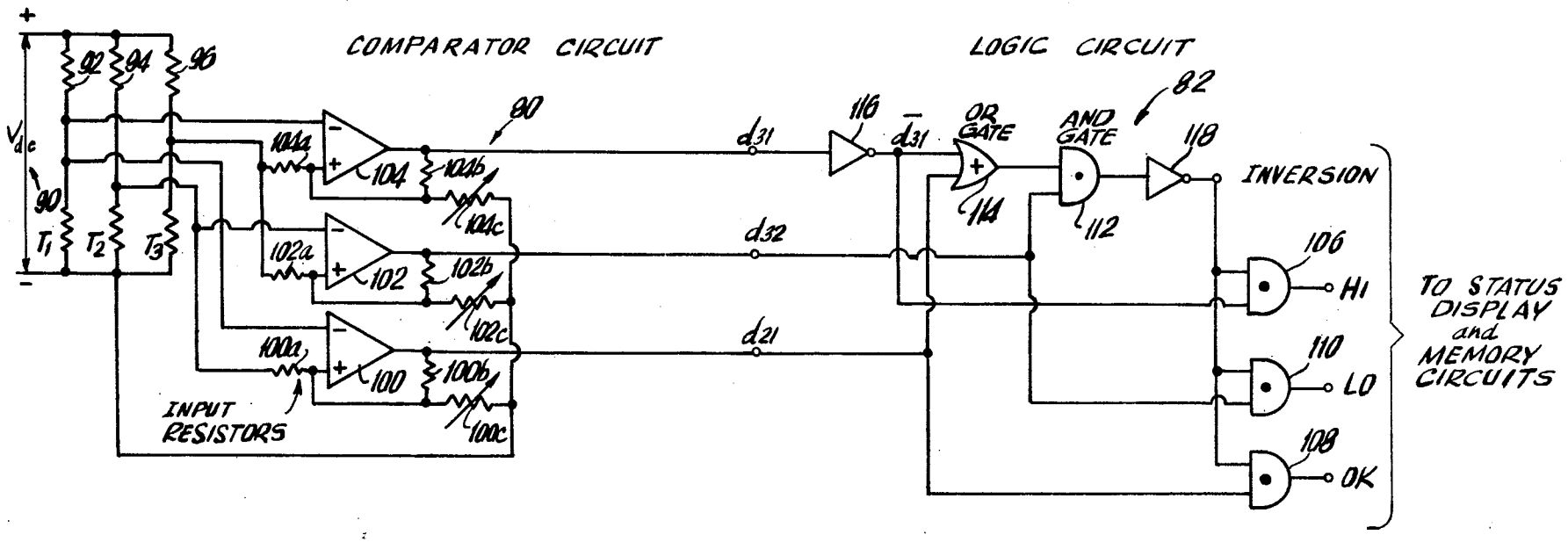
FIG. 2 is a schematic diagram of the electronic circuits utilized in the preferred embodiment of my invention shown in FIG. 1.

The foregoing logic output is achieved by means of the circuits shown in FIG. 2. The thermistors $T_1$, $T_2$, and $T_3$ are connected in parallel between the positive and negative dc power supply voltage, V dc shown at reference numeral 90. Bias resistors 92, 94 and 96 are selected to adjust the ratios of the output voltages of $T_1$, $T_2$ and $T_3$, respectively. The desired ratios as described above are:

Vapor = 0
Oil = 1
Liquid refrigerant = 2

Amplifiers 100, 102 and 104 are connected, respectively, between $T_2$ and $T_1$; $T_3$ and $T_2$; and $T_1$ and $T_3$. Input resistors **100*a*, 102*a* and 104*a*, bias resistors 100*b*, 102*b* and 104*b* and gain control variable resistors 100*c*, 102*c* and 104*c*** complete the respective comparator amplifier circuits. The output signal of the amplifiers, respectively, then is:

amplifier 100 = $d_{21}$
amplifier 102 = $d_{32}$
amplifier 104 = $d_{31}$ The logic circuit 82 is comprised of four AND gates 106, 108, 110 and 112 and one OR gate 114 and two amplifiers 116 and 118 to drive the gates. The operation of the logic circuit may be most readily understood by considering the TABLE II, below:

TABLE II

| Condition Indication (Logic Output) | Circuit Gate | Logic Input Signals |
|---|---|---|
| HI OIL | 106 | $\overline{d_{32}} \cdot \overline{d_{31}} \cdot \overline{d_{21}}$ |
| OK OIL | 108 | $\overline{d_{32}} \cdot d_{31} \cdot \overline{d_{21}}$ |
| LO OIL | 110 | $d_{32} \cdot d_{31} \cdot \overline{d_{21}}$ |
| INVERSION | 114 | $d_{32} \cdot (\overline{d_{31}} + d_{21})$ |

The bar notation indicates the reverse sign of the signal voltage. Thus $\overline{d_{32}}$ = minus $d_{32}$.

The output of the gates 106, 108, 110 and 112 are used to actuate the system status visual display, the memory, the memory display and the main switch cut off.

Figure 3:
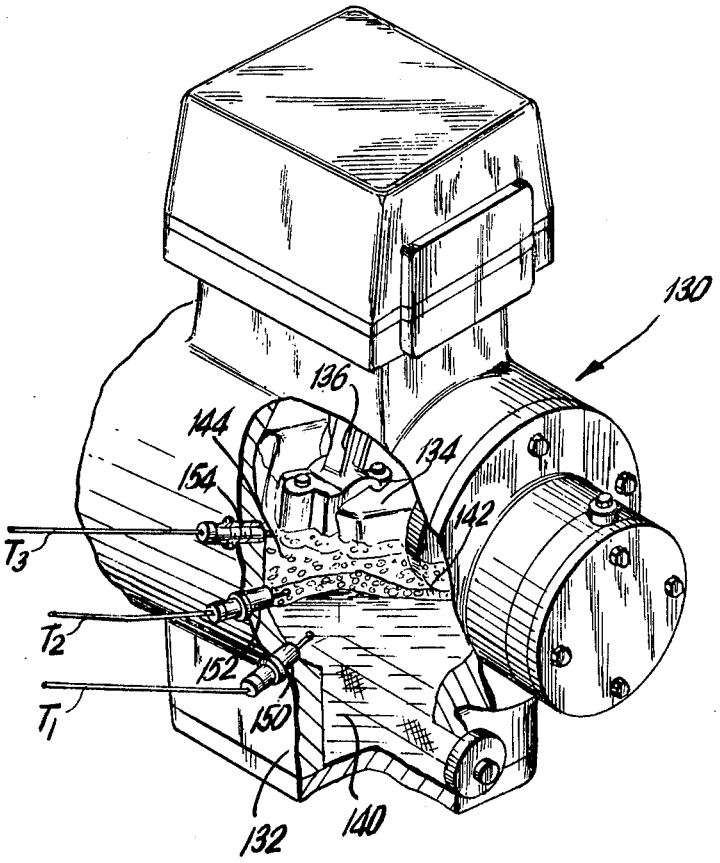
FIG. 3 is a partly cutaway view of a variation of the preferred embodiment of my invention illustrated in FIG. 1.

A second preferred embodiment of my invention is shown in FIG. 3. A refrigeration system compressor 130 is shown in partly cutaway perspective view. The compressor 130 is similar in all respects to the compressor illustrated in FIG. 1 at reference numeral 10. The compressor 130 is comprised of a crankcase 132 within which a crankshaft 134 and connecting rod 136 mounted to the crankshaft. Lubricating oil 140, is retained within the interior of the crankcase. In normal operation, some refrigerant 142 will, from time to time, collect in a layer above the oil 140. Vapor 144 comprised of refrigerant vapor and any non-condensible gases will occupy the crankcase space above the refrigerant.

Ports 150, 152 and 154 are positioned in spaced vertical arrangement in the crankcase wall. The spaced arrangement relates to the normal oil and refrigerant layer levels. in the following manner. Port 150 is positioned just below the minimum normal oil level; port 152 is positioned just above the normal oil level within the normal liquid refrigerant layer level; port 154 is positioned above the normal liquid refrigerant layer in the vapor zone.

Thermistor sensors $T_1$, $T_2$ and $T_3$, respectively, are mounted through the ports 150, 152 and 154 and sealed in fixed positions within the interior of the crankcase. The thermistor leads also designated $T_1$, $T_2$ and $T_3$, respectively, are connected into circuits and display means, identical to those illustrated in the embodiment shown in FIGS. 1 and 2.

The foregoing drawings and description of preferred embodiments of my invention are intended as being merely illustrative, the scope and novelty of my invention being set forth in the following claims.

I claim:

1. A device for detecting physical and thermodynamic conditions of liquid fluids at specified points respectively within an operating mechanical refrigeration system comprised of means for positioning in vertically spaced relationship within a refrigeration system a plurality of electronic sensors responsive to the rate of ambient heat dissipation of fluids at specified points within the refrigeration system, electronic means responsive in its input to distinguish between two or more different liquids, and adapted in its output signals to distinguish between sensor voltage relationships characteristic of normal operating conditions at the specified points and sensor voltage relationships characteristic of abnormal conditions precursing malfunction of the system.

2. A device for detecting the thermodynamic state and the proportions of components in a fluid mixture within an operating refrigeration system, said fluids comprising at least two different liquids, the device comprised of a plurality of electronic sensors mounted within the system in spaced relationship, the sensors being responsive to the rate of ambient heat dissipation, a comparator circuit means responsive to the relative change in the respective sensor output voltage, a logic circuit having bistable elements responsive to the output voltages of the comparator circuit, memory and indicator means responsive to the logic circuit status, whereby the proportions and thermodynamic state of fluids within an operating refrigeration system may be sensed, and normal operating conditions distinguished from non-normal conditions precursing system malfunction may be recorded in the memory and evidenced by the indicator in advance of system malfunction.

3. A device for detecting the thermodynamic state and the proportions of component fluids, said fluids comprising at least two different liquids, within a mechanical refrigeration system compressor crankcase the device comprising a plurality of electronic sensors, the sensors being responsive to the rate of ambient heat dissipation, means for mounting the sensors in vertically spaced relationship and in contact with the fluids within the compressor crankcase, electronic circuit means adapted to compare the output voltage of each sensor, respectively, with the voltage of each of the remaining sensors, logic circuit means having bistable elements responsive to the electronic circuit means output, the logic circuit being adapted to distinguish sensor voltage relationships characteristic of normal thermodynamic operating conditions within the fluids from sensor voltage relationships characteristic of non-normal conditions precursory to system malfunction, and means responsive to the status of the logic circuit.

4. The device of claim 3 wherein the means for mounting the sensors comprises and elongated cylindrical settling chamber having an upper end and a lower end, the settling chamber being mounted exteriorly but adjacent to the compressor crankcase, two hollow tubes, one mounted at the upper end and one mounted at the lower end of the chamber, connecting the interior of the settling chamber to the interior of the compressor crankcase, wherewith the physical and thermodynamic conditions within the compressor crankcase are continuously communicated through the tubes to the interior of the settling chamber, the sensors being mounted through the settling chamber wall in vertically spaced relationship.

5. The device of claim 3 wherein the means for mounting the sensors comprises an elongated rigid member, the member being mounted substantially vertically within the compressor crankcase.

6. The device of claim 3 wherein the means for mounting the sensors comprises sealable threaded apertures located in vertically spaced relationship within a side wall of the compressor crankcase.

7. The device of claim 3 wherein the sensors are thermistors operated in the self-heat mode.

8. A device for continuously detecting the quantity and the concentration of lubrication oil within a mixture of refrigerant, lubricating oil and other substances in an operating refrigeration system compressor crankcase comprised of means for positioning in vertically spaced relationship within and adjacently above the normal operating level of compressor crankcase lubricating oil, a plurality of electronic sensors responsive to rate of ambient heat dissipation, circuit means having an output channel corresponding to each sensor for continuously comparing the voltage output of each sensor respectively with that of the other sensors during operation of the refrigeration system, a logic circuit, being connected to the outputs of the circuit means and being responsive in a bistable manner to the respective output channels of the circuit means whereby the conditions respectively of the liquid refrigerant fluid and lubricating oil in the compressor crankcase may be continuously monitored and abnormal physical and thermodynamic conditions as may develop are detected in advance of malfunction of the refrigeration system.

* * * * *